US012808377B2

(12) United States Patent
North et al.

(10) Patent No.: US 12,808,377 B2
(45) Date of Patent: Nov. 24, 2026

(54) CENTRIFUGAL OIL PUMP DEVICE FOR A VACUUM PUMP

(71) Applicant: Edwards Limited, Burgess Hill (GB)

(72) Inventors: Michael Henry North, Burgess Hill (GB); HeeGeun Jo, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 217 days.

(21) Appl. No.: 18/729,054

(22) PCT Filed: Feb. 21, 2023

(86) PCT No.: PCT/GB2023/050389
§ 371 (c)(1),
(2) Date: Jul. 15, 2024

(87) PCT Pub. No.: WO2023/180682
PCT Pub. Date: Sep. 28, 2023

(65) Prior Publication Data

US 2026/0160252 A1 Jun. 11, 2026

(30) Foreign Application Priority Data

Mar. 24, 2022 (GB) ..... 2204165

(51) Int. Cl.
*F04C 29/02* (2006.01)
*F04C 18/08* (2006.01)
*F04C 25/02* (2006.01)
*F04D 1/00* (2006.01)

(52) U.S. Cl.
CPC ..... *F04C 29/02* (2013.01); *F04C 18/08* (2013.01); *F04C 25/02* (2013.01); *F04D 1/00* (2013.01); *F04C 2240/50* (2013.01)

(58) Field of Classification Search
CPC ..... F04D 29/063; F04D 17/12; F04D 25/06; F04D 29/057; F04D 29/582; F04D 1/00;
(Continued)

(56) References Cited

U.S. PATENT DOCUMENTS 3,877,546 A * 4/1975 Shrader ..... F16N 7/366 184/6.18
5,461,636 A 10/1995 Karube et al.
(Continued)

FOREIGN PATENT DOCUMENTS

CN 207598497 U * 7/2018
CN 112283105 A 1/2021
(Continued)

OTHER PUBLICATIONS

English Translation of JP H09275234 (Year: 1997).*
(Continued)

*Primary Examiner* — Anthony Ayala Delgado
(74) *Attorney, Agent, or Firm* — Shumaker & Sieffert, P.A.

(57) ABSTRACT

A centrifugal oil pump device preferably for a vacuum pump, comprising an oil reservoir extending radially around a vacuum pump driving shaft, the oil reservoir comprising at least one opening, an oil pump inlet arranged below the at least one opening, wherein the oil level in the oil reservoir is arranged to be above an oil pump impeller and the oil is fed downwards to the oil pump inlet, an oil pump driving shaft to be connected to the vacuum pump driving shaft, an oil pump impeller connected to the oil pump driving shaft, the oil pump impeller centrifuging oil to a volute such that oil exits the volute under pressure, and a non-rotating shield member surrounding the oil pump driving shaft, the shield member preventing the oil from being rotated by the rotation of the oil pump driving shaft.

12 Claims, 6 Drawing Sheets

(58) Field of Classification Search
CPC ..... F16N 17/06; F04C 29/02; F04C 18/08; F04C 25/02; F04C 2240/50
See application file for complete search history.

(56) References Cited

U.S. PATENT DOCUMENTS

| | | | | |
|---|---|---|---|---|
| 2016/0348686 | A1 | 12/2016 | Kobayahsi et al. | |
| 2018/0274544 | A1 | 9/2018 | Harrison et al. | |
| 2019/0316596 | A1 | 10/2019 | Munts et al. | |
| 2021/0102537 | A1* | 4/2021 | Wang | F04C 23/02 |
| 2022/0170464 | A1* | 6/2022 | Wang | F04C 25/02 |

FOREIGN PATENT DOCUMENTS

| | | | | | |
|---|---|---|---|---|---|
| DE | 19736017 | A1 | | 2/1999 | |
| FR | 2136664 | A5 | | 12/1972 | |
| JP | 156215 | | | 8/1942 | |
| JP | S4826501 | U | | 3/1973 | |
| JP | H09275234 | A | * | 10/1997 | F04D 29/063 |
| WO | 9213196 | A1 | | 8/1992 | |

OTHER PUBLICATIONS

English Translation of CN-207898497-U (Year: 2018).*
International Search Report and Written Opinion of International Application No. PCT/GB2023/050389 dated May 23, 2023, 11 Pages.
Search Report from counterpart GB Application No. 2204165.1 dated Aug. 23, 2022, 1 Page.
Notification of Reason for Refusal, and translation thereof, from counterpart Japanese Application No. 2024-550793 dated Aug. 4, 2025, 12 pp.

* cited by examiner

CENTRIFUGAL OIL PUMP DEVICE FOR A VACUUM PUMP

This application is a national stage entry under 35 U.S.C. § 371 of International Application No. PCT/GB2023/050389, filed Feb. 21, 2023, which claims the benefit of GB Application No. 2204165.1, filed Mar. 24, 2022, the entire contents of each of which are incorporated herein by reference.

TECHNICAL FIELD

The present disclosure relates to a centrifugal oil pump device for a vacuum pump.

SUMMARY

To ensure long life and reliable operation, the bearings and gears of a dry running vacuum pump are lubricated with oil. In vertical dry running vacuum pumps, it is difficult to lubricate the upper and lower bearings with oil if they are not fully immersed in oil. Moreover, the upper and lower gearboxes of the vacuum pump are both at low pressures during continuous operation. Both the vertical design and the low pressures during continuous operation of the vacuum pump constitute special and challenging features on the design and implementation of reliable oil lubrication systems for vertical dry running vacuum pumps. In particular, it has to be ensured that individual components like the gears and upper and lower bearings are reliably and effectively lubricated with oil but at the same time ensured that said oil is prevented from being leaked into other parts of the vacuum pump system.

Therefore, there exists a need for a reliable and efficient oil lubrication solution for dry running vacuum pumps ensuring reliable and efficient lubrication of individual vacuum pump components.

Known solutions for lubrication of vacuum pump bearings include the use of grease.

One disadvantage of known solutions for lubrication of vacuum pump bearings and other components like the vacuum pump gears is that the conditions of lubricated components has to be monitored frequently as the risk of damage and/or failure of the vacuum system due to under- or over-greasing or the usage of hardened or old grease, as well as possible contamination of the grease is very high.

Other disadvantages include high maintenance costs.

An object of the present disclosure is to provide a reliable and effective oil lubrication solution for vacuum pumps which reduces the risk of vacuum pump failures due to insufficient lubrication of the vacuum pump bearings and/or gears.

The object is achieved by the centrifugal oil pump device according to claim 1 and the vacuum pump according to claim 11 with a centrifugal oil pump device according to claim 1.

According to a first aspect of the present disclosure, the centrifugal oil pump device for a vacuum pump comprises an oil reservoir extending radially around a vacuum pump driving shaft, the oil reservoir comprising at least one opening, an oil pump inlet arranged below the at least one opening, wherein the oil reservoir is arranged to be above an oil pump impeller such that oil is fed downwards to the oil pump impeller via the at least one opening and the oil pump inlet, an oil pump driving shaft to be connected to the vacuum pump driving shaft, an oil pump impeller connected to the oil pump driving shaft, the oil pump impeller centrifuging oil to a volute such that oil exits the volute under pressure, and a non-rotating shield member surrounding the oil pump driving shaft, the shield member preventing the oil from being rotated by the rotation of the oil pump driving shaft. In this way oil from the oil reservoir can be fed to the oil pump inlet without being centrifuged away by the rotating oil pump driving shaft. The oil is then pressurized in the centrifugal oil pump and directed to the respective vacuum pump components for lubrication.

Preferably, the shield member comprises a shield element extending axially along the rotational axis of the oil pump driving shaft. In other words, the shield member forms a collar or sleeve around the outer surface along the rotational axis of the oil pump driving shaft. This may have the advantage that the oil is being prevented from contacting the surface of the rotating oil pump driving shaft and thus, from being centrifuged away from the oil pump inlet and thus prevent oil starvation.

Preferably, the shield member comprises at least two or more radial shield vanes. More preferably, the shield member comprises three or more radial shield vanes and most preferably four or more radial shield vanes. This may have the further advantage that in case the oil gets in contact with the rotating oil pump driving shaft, the rotated oil is intercepted by the radial shield vanes. Rotational flow is prevented and the radial shield vanes act as flow resistance.

Preferably, the radial shield vanes extend radially from the shield member.

Preferably, the radial shield vanes are evenly distributed around the perimeter of the shield member.

Preferably, the shield element is connected to the housing via the one or more radial shield vanes.

Preferably, the at least one opening is arranged radially around the oil pump driving shaft and may radially adjoint to the shield element and is preferably arranged below the radial shield vanes. The at least one opening may be an annular opening arranged radially around the oil pump driving shaft.

Preferably, the oil pump impeller comprises at least two impeller vanes, the impeller vanes having preferably a non-zero radius of curvature. This may have the advantage that oil can pass through the oil pump inlet into the area between the impeller vanes, the impeller vanes can then accelerate the oil, which thus, enters the volute with increased kinetic energy.

Preferably, the impeller vanes each comprise a first end and a second end, wherein the respective first ends are arranged tangentially at the volute. This may have the advantage that losses in kinetic energy of the accelerated oil due to friction at the ends of the impeller vanes can be reduced.

Preferably, the volute is connected to an oil pump outlet and the cross-sectional area of the volute increases with decreasing distance to the oil pump outlet. This may have the advantage that the kinetic energy of the oil is converted into static pressure energy when the oil approaches the oil pump outlet.

According to a second aspect of the present disclosure, the centrifugal oil pump device preferably for a vacuum pump comprises an oil pump inlet arranged at a center of an oil pump impeller connected to a pump oil pump driving shaft, the oil pump driving shaft be connected to a vacuum pump driving shaft, and the oil pump impeller centrifuging oil to a volute such that oil exits the volute under pressure, and a non-rotating shield member surrounding the oil pump driving shaft. In this way the oil can be fed to the oil pump inlet and is then pressurized in the centrifugal oil pump and can be directed to the respective vacuum pump components for lubrication without being centrifuged away by the rotating vacuum pump driving shaft.

Preferably, a gap is present between the shield member and the oil pump driving shaft to vent the volute. This may have the advantage that foaming of the oil due to gas molecules contained in the oil can be prevented.

Preferably, the shield member extends axially along the rotational axis of the oil pump driving shaft. In other words, the shield member forms a collar or sleeve around the outer surface along the rotational axis of the oil pump driving shaft. This may have the advantage that the oil pump driving shaft is sealed along its surface from contact with the oil.

According to a third aspect of the present disclosure, a vacuum pump with a centrifugal oil pump device according to the first aspect of the present disclosure is provided. The vacuum pump comprising a vacuum pump casing, a vacuum pump motor, at least one pump rotor, vacuum pump bearings supporting the pump rotor, as well as a vacuum pump driving shaft. Therein, the oil pump driving shaft is connected to the vacuum pump driving shaft. This may have the advantage that individual components like the bearings and gears of the vacuum pump can be reliably lubricated with oil and thus, failures or interruptions due to wear can be reduced.

Preferably, the vacuum pump with a centrifugal oil pump device according to the first aspect of the present disclosure is a vertical roots pump.

Preferably, the oil pump driving shaft and the vacuum pump driving shaft are integrally formed. This may have the advantage that the manufacturing costs can be reduced.

Preferably, the vacuum pump comprises at least one vacuum pump gear and at least one vacuum pump upper bearing and at least one vacuum pump lower bearing and the centrifugal oil pump device provides oil for lubricating the at least one vacuum pump gear and/or at least one upper and/or at least one lower vacuum pump bearing. This may have the advantage that these components can be lubricated with oil and thus, maintenance costs can be reduced, and continuous and reliable operation of the vacuum pump can be ensured.

According to a fourth aspect of the present disclosure, a vacuum pump with a centrifugal oil pump device according to the second aspect of the present disclosure is provided. The vacuum pump comprising a vacuum pump casing, a vacuum pump motor, at least one pump rotor, vacuum pump bearings supporting the pump rotor, as well as a vacuum pump driving shaft. Therein, the oil pump driving shaft is connected to the vacuum pump driving shaft. In this way, individual components like the bearings and gears of the vacuum pump can be reliably lubricated with oil and thus, failures or interruptions due to wear can be reduced.

Preferably, the vacuum pump comprises an oil reservoir extending radially around the oil pump driving shaft, the oil reservoir comprising at least one opening. The at least one opening of the oil reservoir is connected to the oil pump inlet with a connection member. This may have the advantage that the least one opening of the oil reservoir can be arranged distant to the rotating oil pump driving shaft and oil can be fed from the oil reservoir to the oil pump inlet.

Preferably, the oil pump driving shaft and the vacuum pump driving shaft are integrally formed. This may have the advantage that manufacturing costs can be reduced and reliability of the system can be improved due to decreased number of components and respective risks of failures on the interfaces between the components can be reduced.

Preferably, the vacuum pump comprises at least one vacuum pump gear and at least one vacuum pump upper bearing and at least one vacuum pump lower bearing and the centrifugal oil pump device provides oil for lubricating the at least one vacuum pump gear and/or at least one upper and/or at least one lower vacuum pump bearing. This may have the advantage that these components can be lubricated with oil and thus, maintenance costs can be reduced and continuous and reliable operation of the vacuum pump can be ensured.

BRIEF DESCRIPTION OF DRAWINGS

In the following, the disclosure is described in more detail by means of preferred examples with reference to the accompanying drawings, in which.

DETAILED DESCRIPTION

Figure 1A:
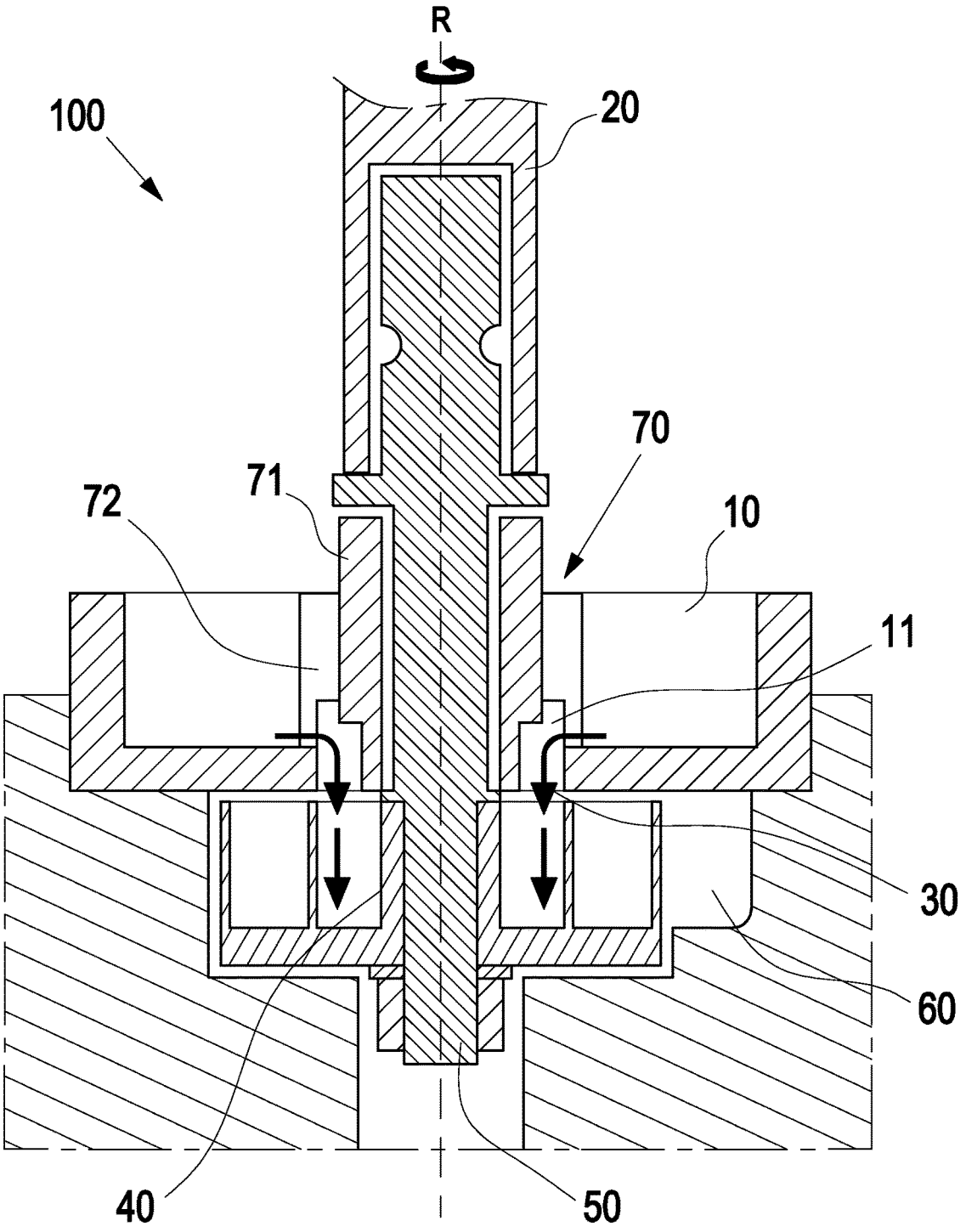
FIG. 1A shows a centrifugal oil pump device preferably for a vacuum pump according to an example of the first aspect of present disclosure.

The centrifugal oil pump device 100 as illustrated in FIG. 1A, comprises an oil reservoir 10 extending radially around an oil pump driving shaft 50. The oil reservoir 10 comprises an annular opening 11 for feeding oil from the oil reservoir 10 to an oil pump inlet 30 that is arranged below the annular opening 11. However, the opening 11 might also have a shape other than an annular shape as shown in FIG. 1A. Further, the number of openings 11 might also be greater than one. As can be seen in FIG. 1A, the oil reservoir 10 is above the oil pump inlet 30. Hence, in the example shown in FIG. 1A, the oil being subject to gravitational force is fed downwards from the reservoir 10 via its opening 11 to the oil pump inlet 30.

As shown in FIG. 1A, the oil pump driving shaft 50 is connected to the vacuum pump driving shaft 20. Further, the oil pump impeller 40 is connected to the oil pump driving shaft 50. During operation of the vacuum pump, the oil pump driving shaft 50 is driven by the rotating vacuum pump driving shaft 20 and the oil pump impeller 40 centrifuges oil to a volute 60 such that the oil exits the volute 60 towards the oil pump outlet 80 (not shown in FIG. 1A) under pressure.

Further, the centrifugal oil pump device 100 as illustrated in FIG. 1A, comprises a shield member 70 surrounding the oil pump driving shaft 50. The shield member is stationary and does not rotate with the oil pump driving shaft 50 during operation of the vacuum pump. In the example shown in FIG. 1A, the shield member 70 comprises a shield element 71 extending axially along the rotational axis R of the oil pump driving shaft 50. In this way the shield element 71 acts as seal for the oil pump driving shaft 50, preventing the oil from contacting the oil pump driving shaft 50 and thus, during operation of the vacuum pump, preventing the oil from being rotated by the rotation of the oil pump driving shaft 50.

Figure 1B:
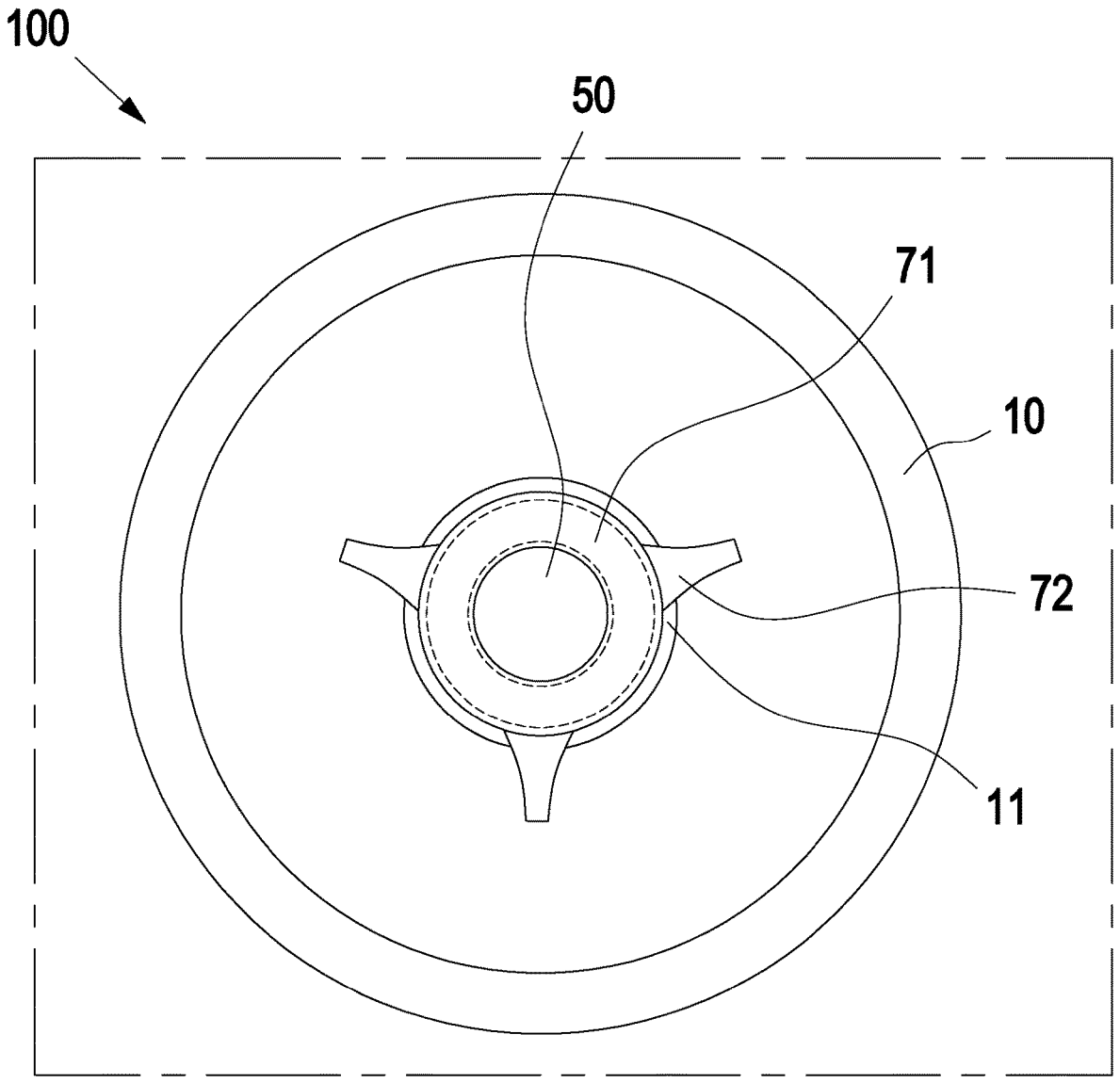
FIG. 1B shows a plan view of the centrifugal oil pump device preferably for a vacuum pump shown in FIG. 1A.

As shown in FIG. 1B, the shield member further comprises three radial shield vanes 72. However, the number of radial shield vanes 72 might be different in another example and might be any number equal or greater than two. The three radial shield vanes 72 provide a further safety measure for the oil pump device. In case the oil contacts the rotating oil pump driving shaft 50 and is thus transferred with rotational energy, the oil rotates away from the center of the oil pump inlet and the oil surface is uneven and thus, the oil flow to the oil pump inlet might be interrupted. Therefore, to prevent the aforementioned effect of rotating oil, the radial shield vanes 72 intercept the oil and the oil transfers its rotational and/or kinetic energy to the shield vanes 72. Further, the radial shield vanes 72 provide mechanical support for the shield element 71 and thus, keep shield element 71 at its respective position.

Figure 1C:
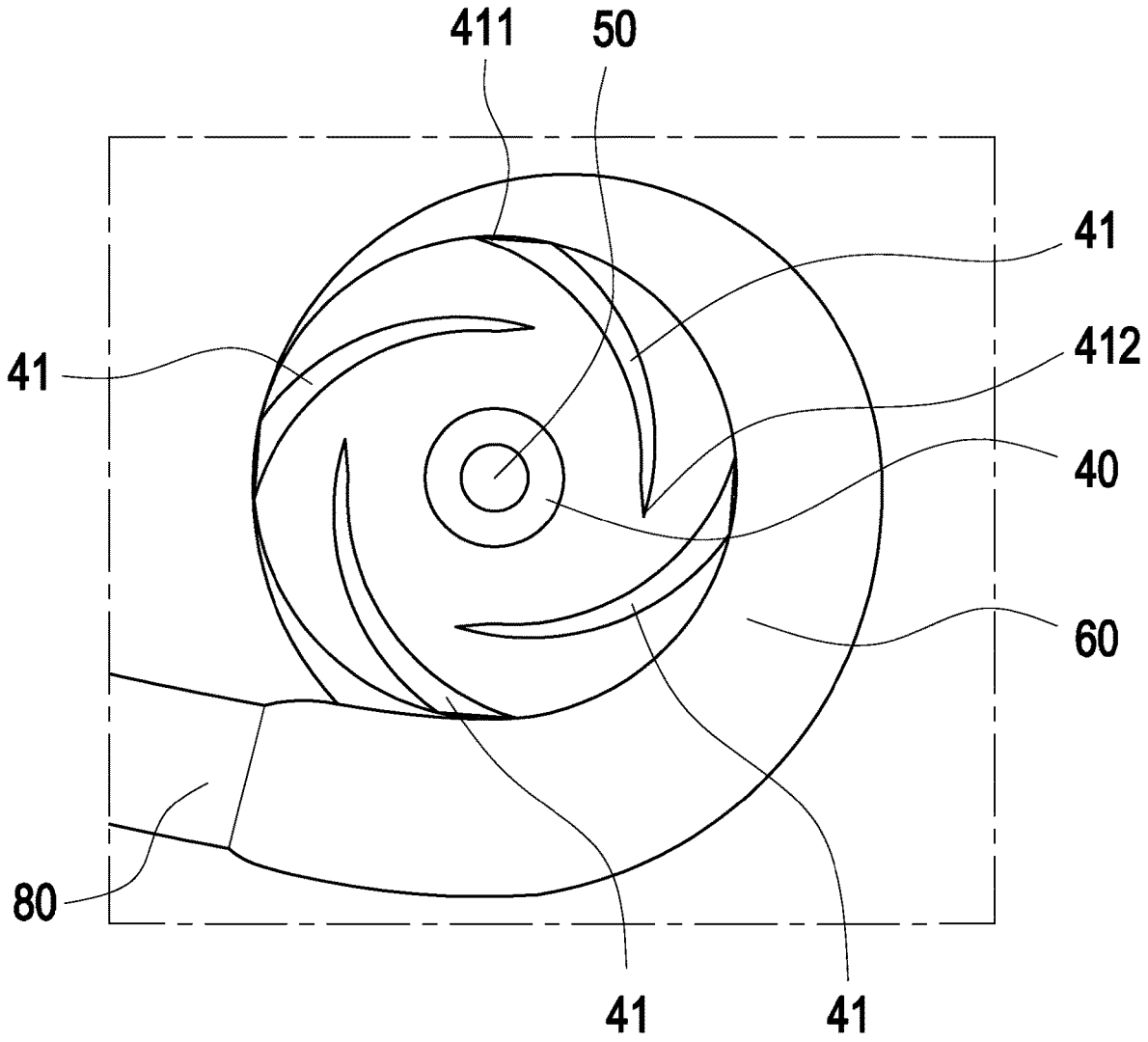
FIG. 1C shows a detailed view of the oil pump device impeller and volute according to an example of the first aspect of present disclosure.

FIG. 1C shows a detailed view of the centrifugal oil pump device impeller 40 and volute 60 of the example illustrated in FIG. 1A. The oil pump impeller 40 shown in FIG. 1C comprises four impeller vanes 41 having a non-zero radius of curvature. However, the number of impeller vanes 41 might be different in another example and might be any number equal or greater than two and/or might not have a non-zero radius of curvature. Further, each of the impeller vanes 41 comprise a first end 411 and a second end 412, wherein the respective first ends 411 are arranged tangentially at the volute 60 and the respective second ends 412 are directed towards the oil pump driving shaft 50 but not connected to the latter. Oil is fed from the oil pump inlet 30 (see FIG. 1A) to the carved-out space between the oil pump impeller 40 and the four impeller vanes 41. When the oil pump impeller 40 is rotated the oil is accelerated by the impeller vanes 41 and discharged to the curved volute 60 with high kinetic energy.

As shown in FIG. 1C, the cross-sectional area of the volute 60 increases with decreasing distance to the oil pump outlet 80. In this way the kinetic energy of the oil decreases towards with decreasing distance to the oil pump outlet 80, whereas the oil pressure increases with decreased distance to the oil pump outlet 80 such that the oil can be discharged from the centrifugal oil pump device 100 under high pressure.

Figure 2A:
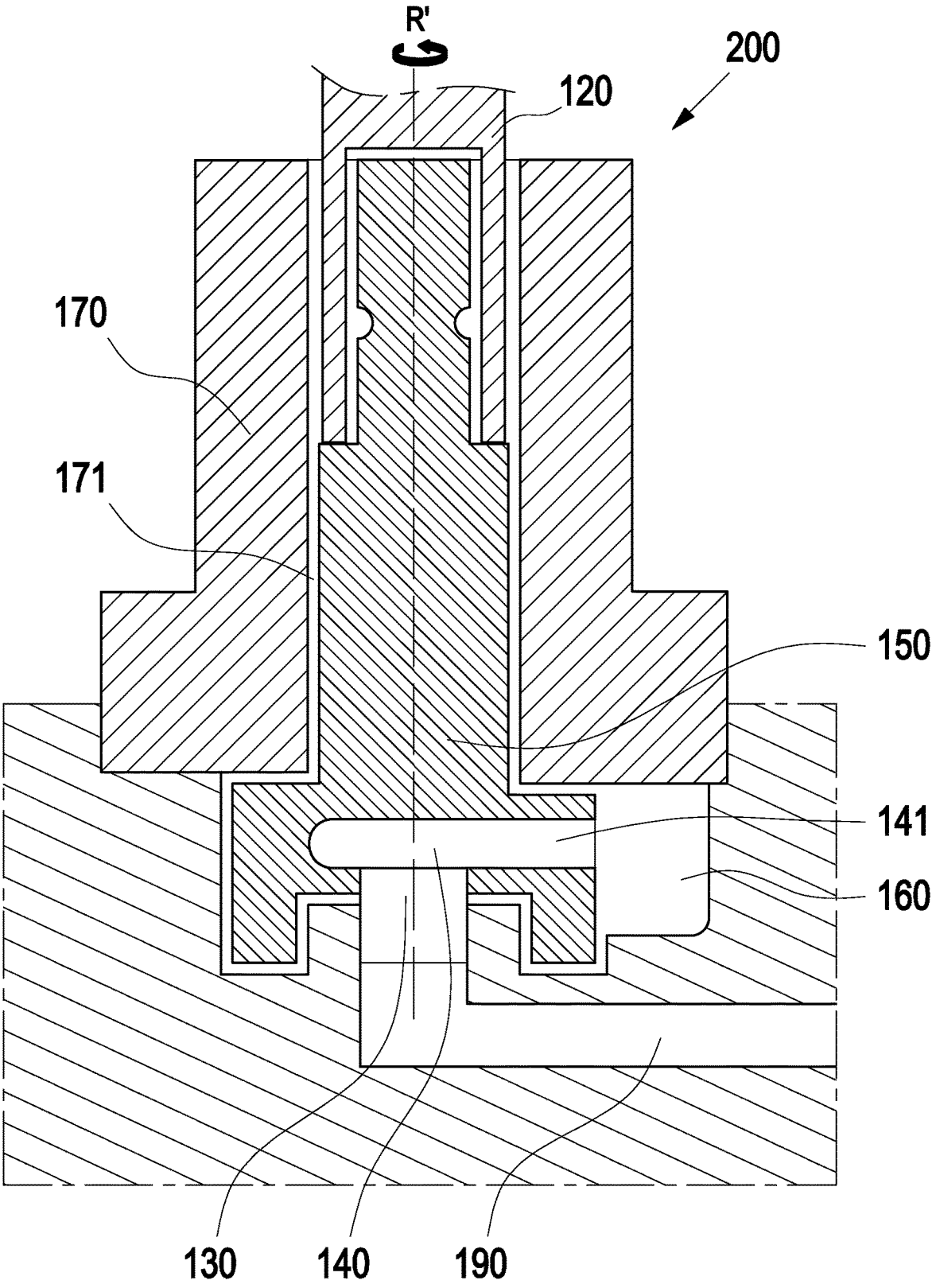
FIG. 2A shows a centrifugal oil pump device preferably for a vacuum pump according to an example of the second aspect of present disclosure.
Figure 2B:
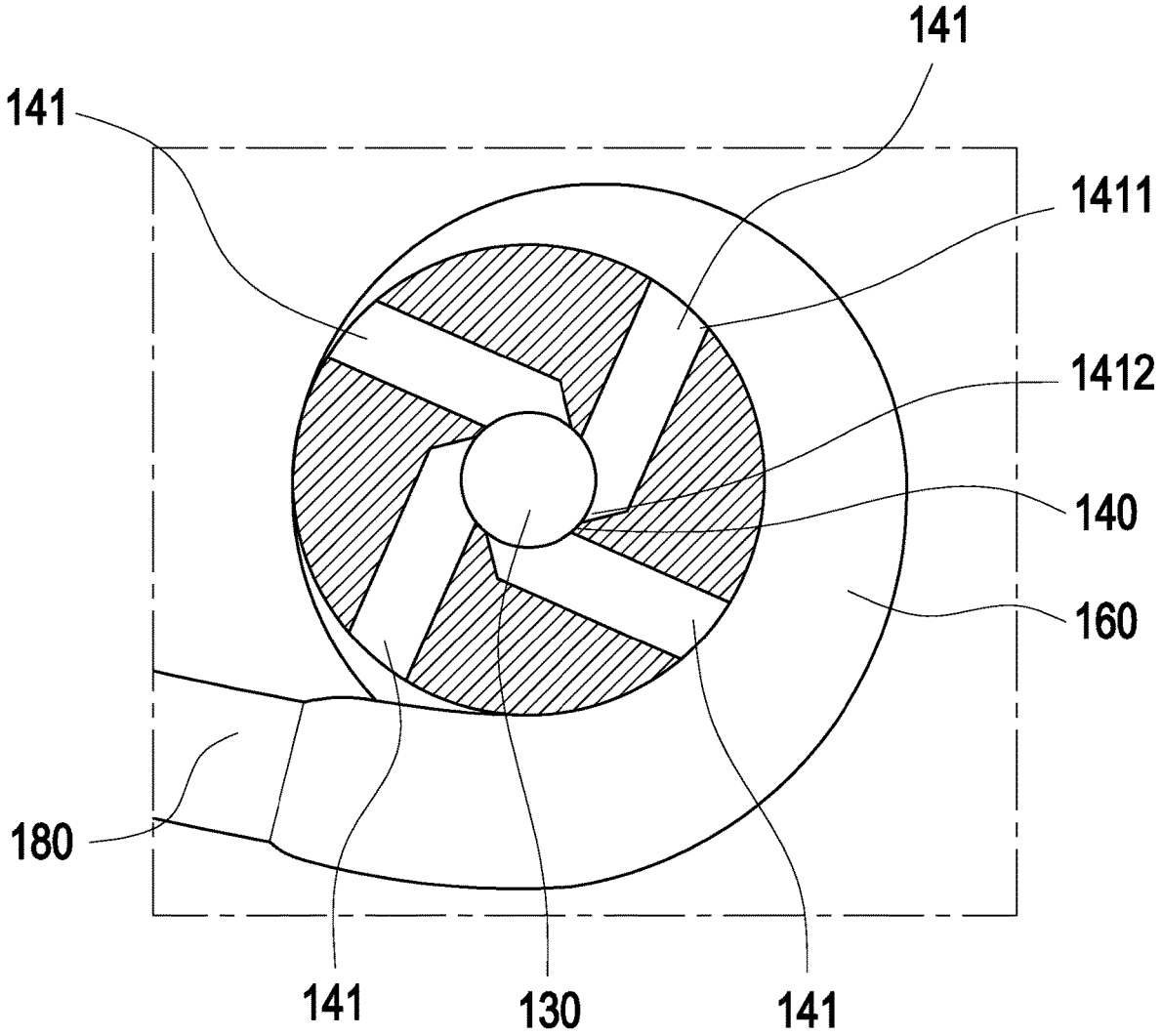
FIG. 2B shows a detailed view of the oil pump device impeller and volute according to an example of the second aspect of present disclosure.

The centrifugal oil pump device 200 as illustrated in FIG. 2A, comprises a vacuum pump driving shaft 120 connected to an oil pump driving shaft 150. Further, an oil pump impeller 140 connected to the oil pump driving shaft 150, wherein an oil pump inlet 130 is arranged at the center of the oil pump impeller 140. As can be seen in FIG. 2A, the oil is fed upwards from an oil reservoir via a connection member 190 such as a channel to the oil pump inlet 130. Said connection member 190 is arranged offset from the vacuum pump driving shaft 120 and thus, unaffected by the rotation of the vacuum pump driving shaft 120. Hence, oil can be fed from the oil reservoir to the centrifugal oil pump device 200 without interruption. When the oil pump driving shaft 150 is rotated by the rotating vacuum pump driving shaft 120 during operation, the oil is fed through the oil pump inlet 130 to impeller channels 141 built for example as drilled holes between the impeller vanes 142, as shown in FIG. 2B and explained in detail below, and accelerated by the impeller vanes 142 towards the volute 160. The oil then travels through the curved volute 160 towards an oil pump outlet 180. Due to the increasing cross-sectional area of the volute 160, the kinetic energy of the oil decreases, whereas the pressure of the oil increases with decreased distance to the oil pump outlet 180. As shown in FIG. 2A, the centrifugal oil pump device further comprises a shield member 170 extending radially and longitudinally around the oil pump driving shaft 150, shielding the oil pump driving shaft 150 such that the oil is not centrifuged away by the rotating oil pump driving shaft 150 during operation. Further, a gap 171 is present between the shield member 170 and the oil pump driving shaft 150 to vent the volute 160. Thus, when the accelerated oil foams due to gas particles enclosed therein, the gap 171 provides venting such that foaming of the oil can be reduced and malfunctioning of the centrifugal oil pump device 200 due to foaming can be prevented.

FIG. 2B shows a detailed view of the impeller 140 and volute 160 of the example illustrated in FIG. 2A. The oil pump impeller 140 shown in FIG. 2B comprises four impeller channels 141. However, the number of impeller channels 141 might be different in another example and might be any number equal to or greater than two. Further, each of the impeller channels 141 comprises a first end 1411 and a second end 1412, wherein the respective first ends 1411 are arranged towards the volute 160 and the respective second ends 4112 are directed towards the oil pump inlet 130. Oil is fed from the oil pump inlet 130 to the impeller channels 141 or impeller holes. When the oil pump impeller 140 is rotated the oil is centrifuged by the impeller 140 towards the volute 160 and discharged to the volute 160 with high kinetic energy.

As shown in FIG. 2B, the cross-sectional area of the volute 160 increases with decreasing distance to the oil pump outlet 180 and thus, the kinetic energy of the oil decreases with decreasing distance to the oil pump outlet 180, where in turn the oil pressure increases with decreased distance to the oil pump outlet 180 and the oil can be discharged from the centrifugal oil pump device 200 (see FIG. 2A) under high pressure to lubricate the e.g. gears and/or bearings of the vacuum pump.

Figure 3:
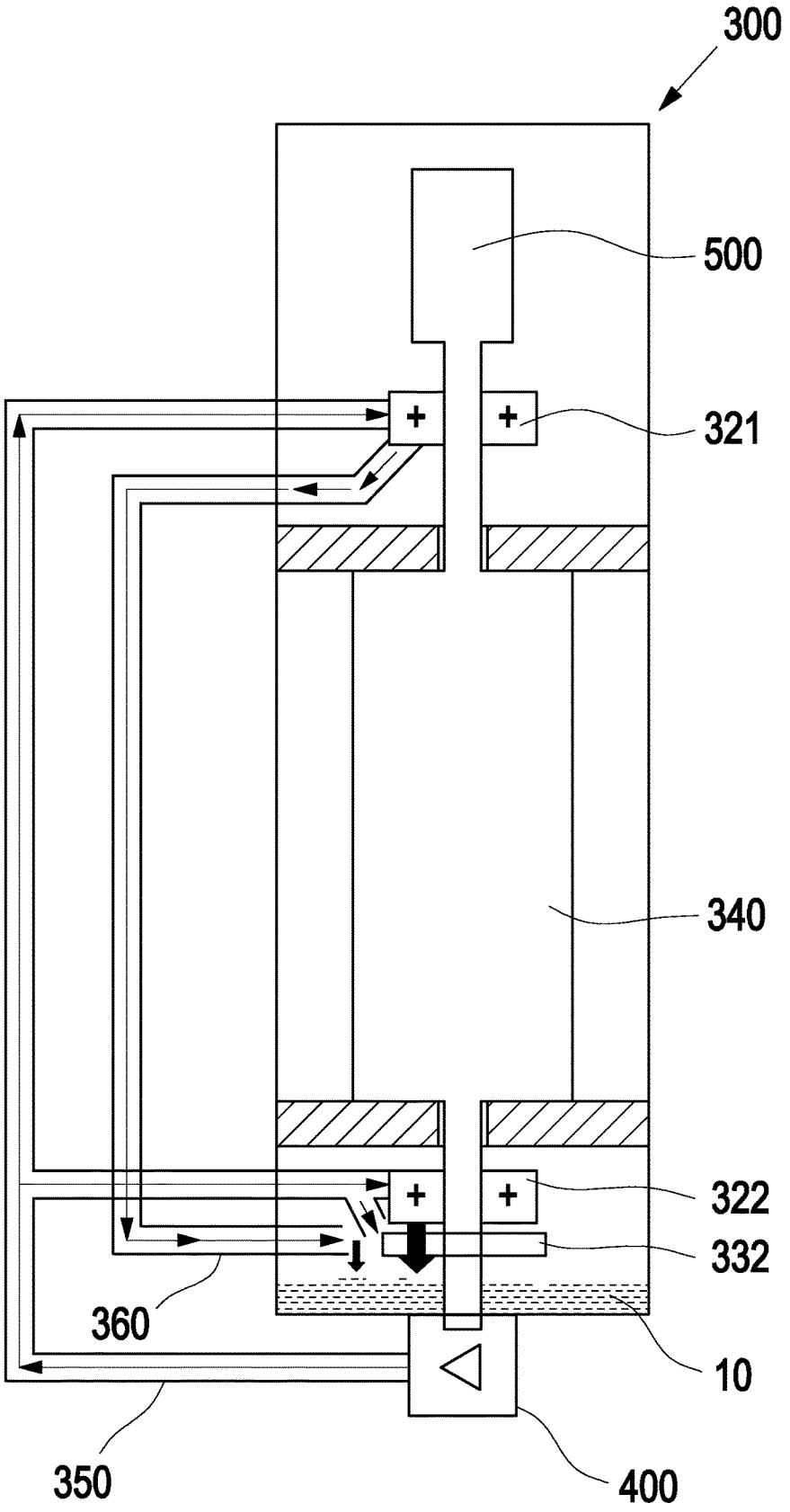
FIG. 3 shows a vacuum pump with a centrifugal oil pump device according to the first or the second aspect of the present disclosure.

FIG. 3 shows a vacuum pump 300 with a centrifugal oil pump device 400 according to the example shown in FIG. 1A, 1B, 1C or 2A, 2B. In the example shown in FIG. 3, the vacuum pump 300 comprises a motor 500 which drives the vacuum pump driving shaft 20, 120. Further, an upper bearing 321 and a lower bearing 322 are arranged at opposite ends of the vacuum pump rotors 340. Further, the vacuum pump 300 may comprise at least one lower gear 332 at an end of the vacuum pump rotor 310 to provide synchronization with a second vacuum pump driving shaft, in particular for a screw pump, scroll pump, roots pump or the like. Also, the gear 332 could be placed upper or lower one of either side. However, the present disclosure is not limited to a specific arrangement of the bearings 321, 322 and/or the at least one gear 332. During operation, the centrifugal oil pump device 400 discharges pressurized oil to the oil pump outlet 80, 180 which is then fed to the upper bearing 321 and lower bearing 322 via a connection member 350. Another connection member 360 feeds the oil from the upper bearing 321 back to the oil reservoir 310. From the lower bearing 322 and lower gear 332, the oil is discharged back to the oil reservoir 310 In this way, the upper bearing 321, the lower bearing 322 and the at least one gear 332 of the vacuum pump can be efficiently and reliably lubricated by the centrifugal oil pump device 400.

Thus, a centrifugal oil pump device is provided for effective and reliable lubrication of individual vacuum pump components.

The invention claimed is:

1. A centrifugal oil pump device for a vacuum pump, comprising:

an oil reservoir extending radially around a vacuum pump driving shaft, the oil reservoir comprising at least one opening, an oil pump inlet arranged below the at least one opening, wherein the oil reservoir is arranged above an oil pump impeller such that oil is fed downwards to the oil pump impeller via the at least one opening and the oil pump inlet, an oil pump driving shaft to be connected to the vacuum pump driving shaft, the oil pump impeller connected to the oil pump driving shaft, the oil pump impeller centrifuging oil to a volute such that oil exits the volute under pressure, and a non-rotating shield member surrounding the oil pump driving shaft, the non-rotating shield member preventing the oil from being rotated by the rotation of the oil pump driving shaft, wherein the non-rotating shield member comprises at least two radial shield vanes.

2. The centrifugal oil pump device according to claim 1, wherein the non-rotating shield member comprises a shield element extending axially along a rotational axis of the oil pump driving shaft.

3. The centrifugal oil pump device according to claim 2, wherein the at least one opening is arranged radially around the oil pump driving shaft and radially adjoints to the shield element.

4. The centrifugal oil pump device according to claim 2, wherein the at least one opening is an annular opening arranged radially around the oil pump driving shaft.

5. The centrifugal oil pump device according to claim 1, wherein the at least two radial shield vanes extend radially from the non-rotating shield member.

6. The centrifugal oil pump device according to claim 1, wherein the at least one opening is arranged below the at least two radial shield vanes.

7. The centrifugal oil pump device according to claim 1, wherein the oil pump impeller comprises at least two impeller vanes.

8. The centrifugal oil pump device according to claim 7, wherein the at least two impeller vanes have a non-zero radius of curvature.

9. The centrifugal oil pump device according to claim 1, wherein the volute is connected to an oil pump outlet and a cross-sectional area of the volute increases with decreasing distance to the oil pump outlet.

10. A vacuum pump with a centrifugal oil pump device, the centrifugal oil pump device comprising:

an oil reservoir extending radially around a vacuum pump driving shaft, the oil reservoir comprising at least one opening, an oil pump inlet arranged below the at least one opening, wherein the oil reservoir is arranged above an oil pump impeller such that oil is fed downwards to the oil pump impeller via the at least one opening and the oil pump inlet, an oil pump driving shaft to be connected to the vacuum pump driving shaft, the oil pump impeller connected to the oil pump driving shaft, the oil pump impeller centrifuging oil to a volute such that oil exits the volute under pressure, and a non-rotating shield member surrounding the oil pump driving shaft, the non-rotating shield member preventing the oil from being rotated by the rotation of the oil pump driving shaft, wherein the non-rotating shield member comprises at least two radial shield vanes.

11. The vacuum pump according to claim 10, wherein the oil pump driving shaft and the vacuum pump driving shaft are integrally formed.

12. The vacuum pump according to claim 10, wherein the vacuum pump comprises at least one vacuum pump gear and at least one vacuum pump upper bearing and at least one vacuum pump lower bearing and the centrifugal oil pump device provides oil for lubricating the at least one vacuum pump gear and/or the at least one vacuum pump upper bearing and/or the at least one vacuum pump lower bearing.

* * * * *